United States Patent [19]

Harris

[11] 4,178,238

[45] Dec. 11, 1979

[54] APPARATUS FOR PROCESSING LOW-GRADE AGGREGATE ORE

[76] Inventor: Loyd F. Harris, 118 N. Cole St., Molalla, Oreg. 97038

[21] Appl. No.: 762,255

[22] Filed: Jan. 25, 1977

[51] Int. Cl.[2] ..... B07B 1/18; B07B 1/24

[52] U.S. Cl. ..... 209/270; 209/284; 209/288; 209/293; 209/299

[58] Field of Search ..... 209/270, 284, 288, 289, 209/293, 299, 3

[56] References Cited

U.S. PATENT DOCUMENTS

| | | | |
|---|---|---|---|
| 6,791 | 10/1849 | Von Schmidt | 209/293 |
| 448,189 | 3/1891 | Bennett | 209/284 |
| 758,565 | 4/1904 | Shier | 209/284 |
| 1,090,326 | 3/1914 | Michaelsen | 209/284 |
| 1,187,927 | 6/1916 | Ramsey | 209/42 |
| 1,309,754 | 7/1919 | Dovel | 209/297 |
| 1,861,578 | 7/1932 | Munro | 209/270 |
| 1,948,606 | 2/1934 | Weinig | 209/288 |
| 2,288,742 | 7/1942 | Ransohoff | 209/270 |
| 2,290,315 | 7/1942 | Cline et al. | 209/270 |
| 2,296,851 | 9/1942 | Henry | 209/284 |
| 2,315,281 | 3/1943 | Smith | 209/284 |
| 2,983,378 | 5/1961 | Hilkemeier | 209/284 |
| 3,426,898 | 2/1969 | Cruickshank | 209/284 |

*Primary Examiner*—Morris O. Wolk
*Assistant Examiner*—Bradley Garris
*Attorney, Agent, or Firm*—A William King

[57] ABSTRACT

Apparatus for use with extremely low-grade aggregate ore, for deriving a concentrate comprised of metal-bearing ore particles having densities within a predetermined range. The apparatus is in the form of a mobile, self-sustained system including a vehicle trailer for horizontal transport and elevated operational support, plus an integral power system capable of supplying the total energy requirements of the apparatus. Two types of particle size separation are applied, followed by compaction and particle density separation. Two density separation areas are provided to effect both coarse and fine gravitational shaving actions, and dual adjustment controls are also provided to vary the shaving force intensity to derive the concentrate independently of changes in the particular characteristics of the aggregate being processed. The apparatus includes outer and inner cylindrical chambers concentrically mounted on the trailer so as to be tiltable and rotatable. The peripheral side wall of the inner chamber is perforated to permit particles of aggregate ore introduced therein to pass to the outer chamber. A ribbed helical member disposed around the inner surface of the outer chamber urges these particles toward one end of the chamber as the two containers are rotated. Liquid flowing over the rib member, toward the opposite end of the outer chamber, creates a turbulence which provides the gravitational shaving force and effects particle density separation. The force of this turbulence is adjustable by varying either or both the volumetric flow rate of the liquid and the tilt of the two chambers.

4 Claims, 9 Drawing Figures

10
12
16
18
22
24
26
28
42
44
46
62
63
66
68
72
74
80
84
86
88
90
104
105
106
114
116
8

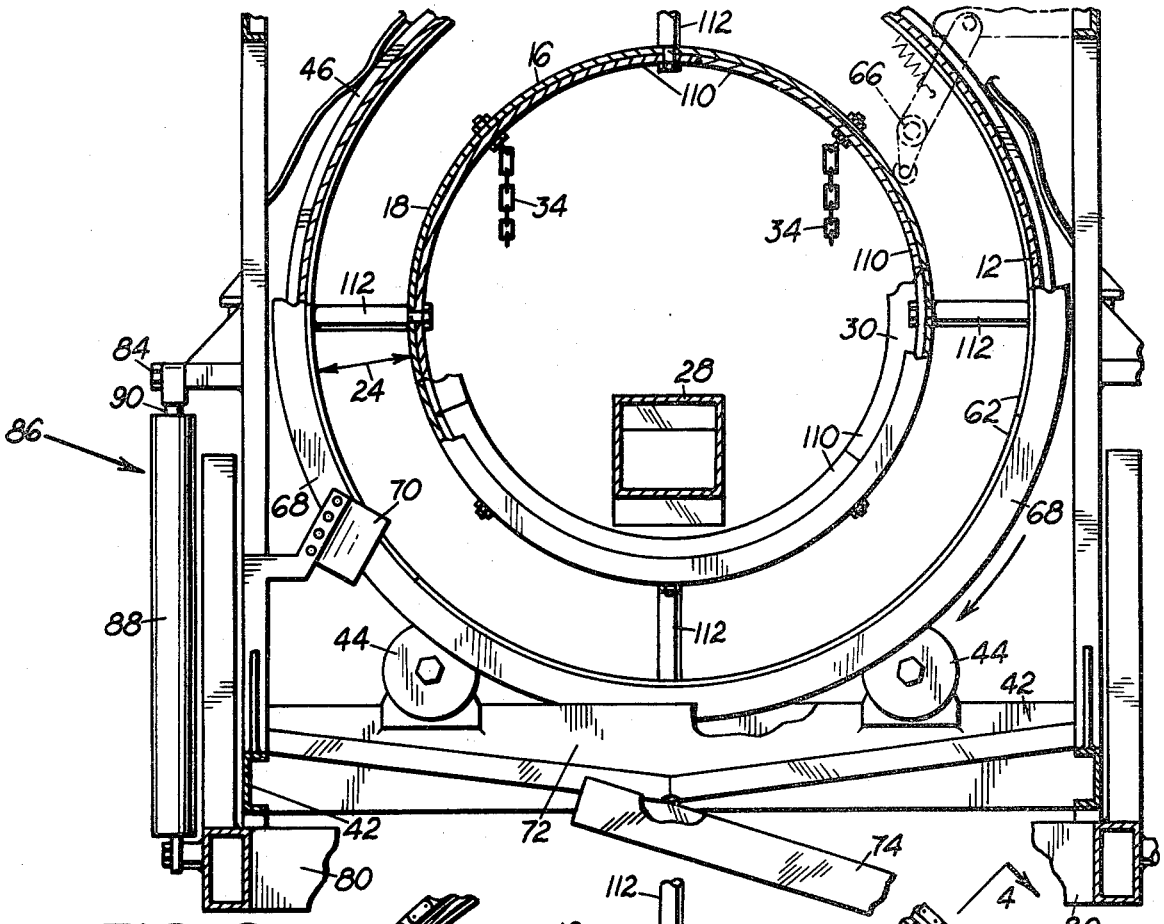
FIG. 2
FIG. 6
FIG. 7
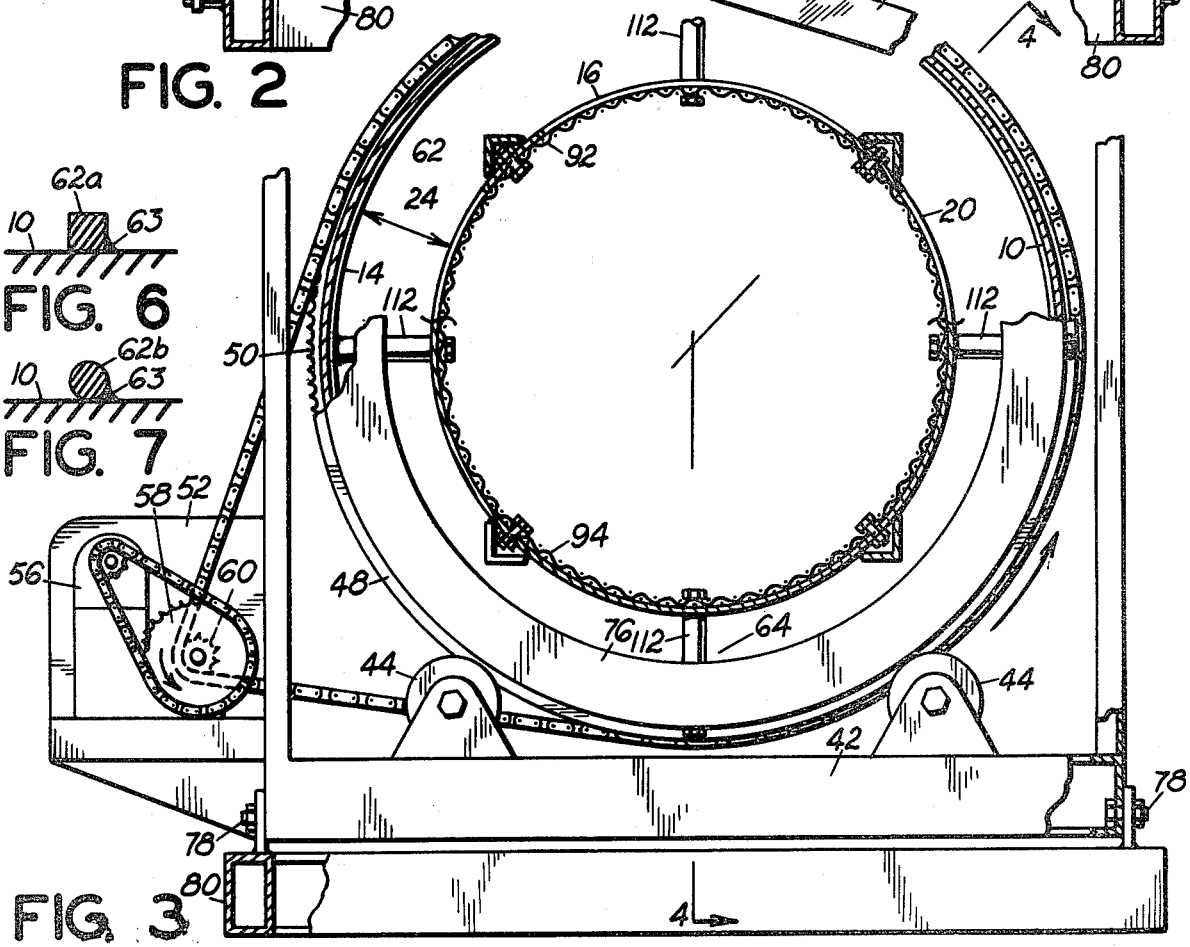
FIG. 3

APPARATUS FOR PROCESSING LOW-GRADE AGGREGATE ORE

BACKGROUND OF THE INVENTION

The present invention relates to improvements in gravity ore separators and is particularly directed to the efficient separation of valuable metals from an aggregate ore containing a relatively small percentage thereof.

Comparable known prior art separators, such as that disclosed by Katter U.S. Pat. No. 3,815,737, generally move metal-bearing aggregate ore across a perforate member so as to permit small particles or fines to fall into a classifying chamber where they are compacted into layers according to density with the heavier fines in the lowermost layers. Once compaction is achieved, the fines are advanced upwardly, by a first rotating helix formed in the bottom surface of the classifying chamber, through a shaving area, and toward an outlet. The shaving area includes a second rotating helix protruding downwardly by a predetermined distance into the classifying chamber and arranged so as to move the upper layers of the fines in a direction opposite to that of the first helix. The second helix functions to shave off the upper layers of the fines, so that only a predetermined quantity of the heaviest fines—the desired concentrates—are conveyed by the first helix to the outlet. These concentrates can then be transported to a distant plant for processing.

Several difficulties attend this form of classification and have heretofore precluded efficient high-percentage recovery. A major difficulty with mechanical classifiers of the type described is that the shaving action is governed by physical dimensions of the mechanical shaver, rather than by the density of the fines, and is therefore not readily adjustable to compensate for aggregate ores of varying densities. Such a shaving action being unable to differentiate between high- and low-grade aggregate produces a concentrate that varies in quality essentially as the quality of the aggregate varies. The provision of the complex machinery necessary to vary the action of the mechanical shaver according to the density of the aggregate would increase the cost and complexity of the classifier considerably.

Another deficiency of known comparable mechanical separator/classifiers is that aggregate conglomerates moving through the system tend to bridge the perforations of the perforate member and inhibit the passage of fines into the classifying assembly. Some mechanical classifiers provide water flow apparatus in order to decrease this clogging of the classifier; however, the action of the water is usually such as to interfere with the shaving action of the apparatus and thereby lower its overall efficiency.

Still another deficiency of known mechanical classifier/separators is their inability to separate large metal-bearing particles from similarly large gravel particles without requiring the apparatus to be periodically stopped to permit the large metal-bearing particles or nuggets to be removed by hand.

Known aggregate ore processing equipment has also failed to adequately resolve the competing considerations of accuracy, cost, capacity and portability. A major portion of valuable metal resources are located at numerous diverse locations in relatively modest amounts. Economical use of these resources inherently demands an apparatus which can collect concentrates with a certain level of accuracy from these diverse locations for collective processing at a distant smelter plant. The modest amount of valuable metal relative to total aggregate ore at each remote site inherently demands an inexpensive large volume classifier which is readily transportable, requires a minimum set-up time and is virtually self-sustained. Conversely, the relative scarcity of the valuable metals demands an optimization of classifying accuracy. Known classifying systems have failed to resolve these competing considerations and have heretofore denied the industry access to small-scale ore deposits which collectively comprise large quantities of the valuable metal.

What is needed therefore, and what is provided by the present invention, is an ore classifier of the mechanical separator type which can achieve inherently high percentage recovery of valuable metal from low-grade aggregate ore through the use of a shaver-classifier mechanism of simple and uncomplex design which differentiates among particles according to the density thereof without resulting in any significant lowering of the system through-put efficiency and which is readily transportable to a remote site, efficiently placed in operation, and requires minimal support facilities.

SUMMARY OF THE INVENTION

The present invention is directed to improvements in ore aggregate processing equipment of the general type described in the aforementioned Katter patent, for deriving concentrates from metal-bearing aggregate ore. In lieu of fixed mechanical shaving, the exemplary embodiment of the present invention equips the classifying chamber with a helical riffle to advance fines upwardly and a directed flow of liquid to advance tailings downwardly. Each rib-section of the helical riffle extends upwardly in the path of the downwardly flowing liquid creating turbulence or riffling and partial dams. Turbulence separates lighter fines and combines them with the liquid, while, the dams permit heavy fines to settle and compact against the upstream side of the rib-portion. Accordingly, this combined gravitational shaving action permits only those fines having the prerequisite density to move to the concentrate outlet. The resultant accuracy permits processing of extremely low-grade aggregate ore which varies widely in its particular characteristics to derive a concentrate comprised of metal-bearing ore particles having the prerequisite densities.

The classifying chamber and an inner separation chamber are mounted upon supporting structure so as to be rotatable and tiltable relative to the support structure. A selectively actuated hydraulic system permits the operator to vary the tilt angle of the chambers and thereby effect coarse adjustment of the gravitational shaving action in response to periods of extremely poor or extremely rich aggregate. Additionally, the operator can vary the volumetric flow rate of the liquid thereby effecting a fine adjustment of the gravitational shaving action in response to smaller shifts in the relative richness of the aggregate. Further, the spacing and height of the rib-members are progressively decreased from the lower end of the classifying chamber to its upper end and, hence, the gravitational shaving force is applied in various amounts over a predetermined transverse spacing to provide coarse and fine shaving action zones. The resultant economies achieved in efficiency, complexity and cost, by eliminating the need for complex apparatus to vary a mechanical shaving action, permit economical processing of extremely low-grade ore at an inherently high recovery rate.

The inner separation chamber includes a chain-crushing station and a perforate member and, hence, two kinds of particle size separation are provided. First, most of the loosely bound aggregate conglomerates are crushed to release metal particles trapped therein and to prevent such particles from being discharged from the apparatus as tailings. Second, the crushed aggregate is vibrated by the tilted rotational action of the chambers while moving across a perforate member to effect multi-stage particle separation into groups having a predetermined range of cross sectional dimensions, one group of which is permitted to pass to the classifying chamber. Optimum system efficiency is thus enhanced by presenting a maximum amount of selected sized particles to the classifying chamber. Still other features, such as controlled aggregate in-feeding, optimum through-put delivery and the like provide optimum system efficiency in terms of through-put capacity and metal recoverability without thereby necessitating complex design and excessive manufacturing costs.

In anticipation of the fact that accurate, efficient, and inexpensive classification will permit utilization of remote, small-scale mines as the source of valuable metals, the apparatus of the present invention is mounted upon a vehicle trailer to form a mobile, self-sustained unit. The vehicle trailer serves the dual functions of both transporting the apparatus to remote placer mines and the like and providing system support during operation. A self-sustained power system, mounted on the trailer, supplies the total energy requirements of the system. Further, a selectively actuated, integral lifting means lowers the classifying unit to a generally horizontal transport position to permit optimum chamber capacity having a height within roadway height regulations and rapidly raises the unit to a plurality of elevated working positions. Accordingly, the system is easily transported to remote mining sites having minimal facilities and efficiently placed into operation.

It is therefore a principal objective of the present invention to provide a new and improved ore aggregate processing system, for remote processing of extremely low-grade, metal-bearing aggregate ore which can process up to 7 cubic yards (5.4 cubic meters) of aggregate per hour at a recovery rate greater than eighty percent by combining mechanical-type separation and compaction with gravitational-type shaving apparatus of simple efficient design which can differentiate particles according to the densities thereof.

It is a further objective to provide a method and apparatus for deriving a concentrate comprised of particles having densities within a predetermined range, from extremely low-grade ore independently of changes in the particular characteristics of the aggregate being processed, by providing a gravitational shaving force which is efficiently adjustable to compensate for fluctuations in the relative richness of the aggregate.

It is yet another objective to provide an inexpensive, large volume and accurate classifying system, for use in marginal, small-scale mining sites having minimal facilities, which is fully transportable, requires a minimal installation time, and has a self-sustained integral power system.

The foregoing and other objectives, features and advantages of the invention will be more readily understood upon consideration of the following detailed description of the invention, taken in conjunction with the accompanying drawings.

BRIEF DESCRIPTION OF THE DRAWINGS

FIGS. 1A–1B provide a plan view of an exemplary portable classifier of the present invention depicting a vehicular trailer mounting scheme, a self-sustained power system mounted on the vehicular trailer, and the classifier deposed in a tilted operating position.

FIG. 2 is a front end view of the classifier of FIG. 1 depicting the classifier in a generally horizontal transport position.

FIG. 3 is a rear end view of the classifier of FIG. 1 depicting the classifier in a generally horizontal transport position.

FIGS. 5–7 are cross section views of exemplary embodiments of the helical rib-member of the classifiers of FIGS. 1–4.

FIG. 8 is a partial cross section of an exemplary input hopper of the classifiers of FIGS. 1–4 as seen from the top thereof.

DETAILED DESCRIPTION OF THE INVENTION

Figure 1A:
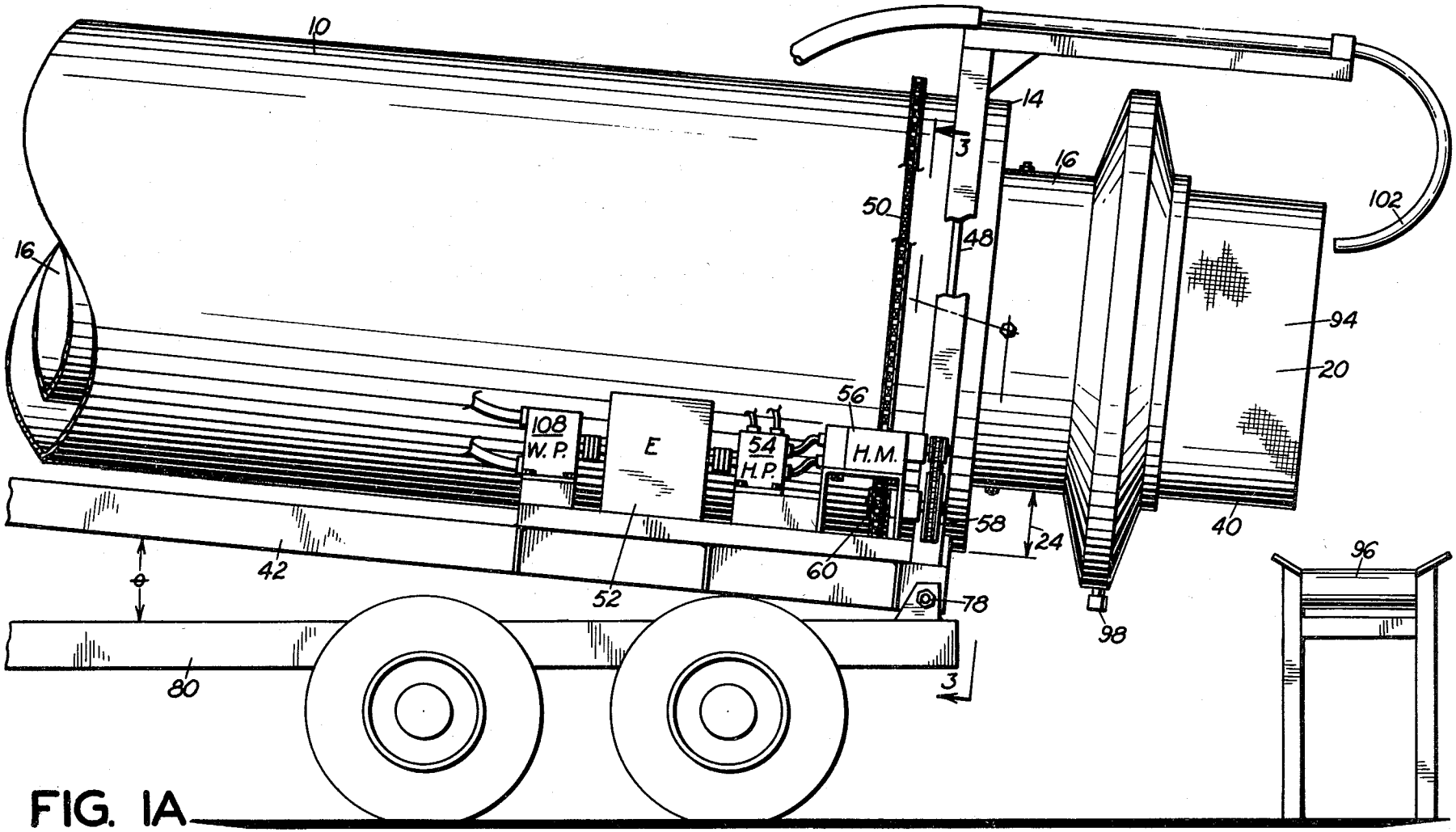

Referring now to the drawings, particularly FIGS. 1A–1B, 2–4, a preferred embodiment of the present invention is set forth wherein 10 is a tubular imperforate casing tiltably mounted on suitable supporting structure so as to have an upper end 12 and a lower end 14 and so as to be rotatable about its longitudinal axis. The ends of the casing are open and permit an operator to easily view action occurring therein, the importance of which is hereinafter more fully explained.

A cylindrical separation barrel 16 is mounted within the casing and extends therefrom so as to have an upper end 18 and a lower end 20 adjacent the upper and lower ends 12 and 14 of the casing, respectively. The separation barrel 16 has an outer diameter 22 which is less than the inner diameter of the casing 10 so as to define a visible working space 24 therebetween.

Figure 4:
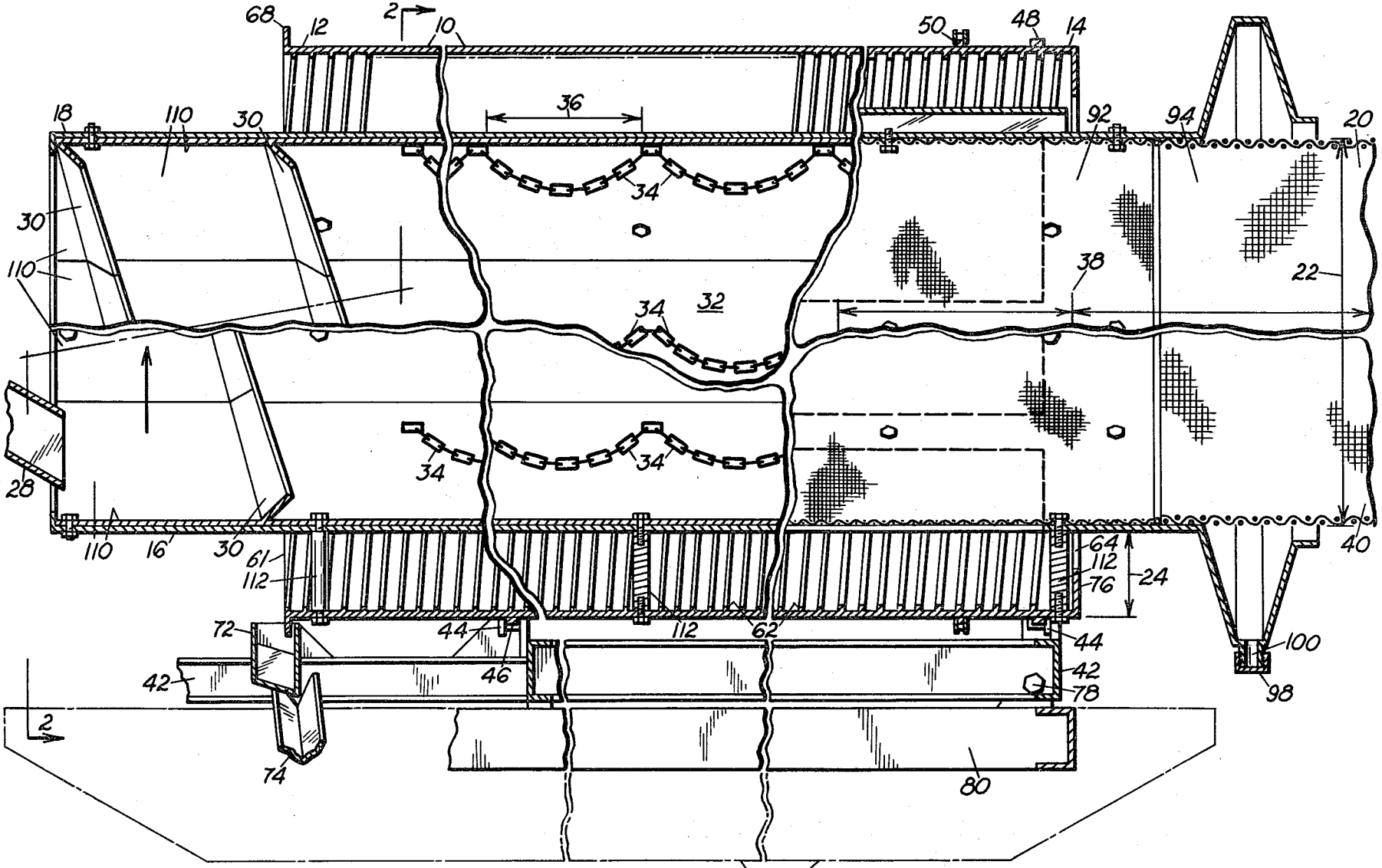
FIG. 4 is a cross section view of an exemplary fixed-site classifier of the present invention depicting the classifier in a generally horizontal transport position suitably mounted on a slab and also depicting exemplary internal components of both the portable and fixed-site embodiments.

A hopper 26 mounted adjacent the upper end 18 of the barrel 16 conducts metal-bearing aggregate ore into the barrel via an inlet chute 28. Referring particularly to FIG. 4, the separation barrel 16 includes an auger 30 mounted therein interior of the inlet chute 28 for encouraging aggregate to move from the hopper 26 into a crushing station referred to generally as 32. The cross-sectional area and orientation of the auger 30 is such that the rotation of the casing 10 causes an infeeding of aggregate ore proportional to system through-put capacity.

A plurality of chains 34 mounted within the crushing station 32 have excess lengths 36 permitting movement thereof and providing a "beating action" as the separation barrel 16 rotates with the casing 10. This beating action crushes most of the more loosely bound aggregate conglomerates releasing metal-bearing particles trapped therein and, hence, enhances the recoverability efficiency of the system. A perforate member 38 mounted within the separation barrel 16 interior of the crushing station 32, permits fines having a first range of cross sections to fall into the working area 24 and conducts coarse particles having cross sections greater than those of the fines from the crushing station 32 to an outlet 40.

The casing 10 is rotatably mounted upon a casing support member 42 by four double-flange wheels 44. The casing 10 includes a pair of protruding ribs 46 and 48 disposed on its outer surface adjacent its upper and lower ends 12 and 14, respectively. The double-flange wheels 44 engage the protruding ribs 46 and 48 and thereby provide confining but rotatable support.

The casing 10 further includes a toothed rib 50 disposed on its outer surface adjacent its lower end 14. A gasoline engine 52 drives a hydraulic pump 54 and a hydraulic motor 56. The hydraulic motor 56 has a power takeoff assembly 58 and provides continuous rotary force therethrough to a drive sprocket wheel 60. The drive sprocket wheel 60 is in driving engagement with the toothed rib 50 and imparts continuous rotary motion to the casing 10. Other means, however, such as a belt-drive, can be employed to rotate the casing 10 without departing from the invention as described herein.

As best seen in FIG. 4, a helical riffle 62 mounted on the inner surface of the casing 10 comprises one or more inwardly protruding ribs (shown in cross section in FIG. 5) disposed radially about the inner surface thereof and extending helically from the lower end 14 to the upper end 12. The riffle rotates with the casing and urges fines falling therein from the lower end to an outlet 64. The fact that the riffle 62 comprises a plurality of radially spaced helical ribs increases the through-put rate caused by the rotational speed of the casing by a factor of two for each rib and, hence, an alternate "fixed site" embodiment having 12 helical ribs processes up to 100 cubic yards (79 cubic meters) of low-grade aggregate ore per hour at a recovery rate of greater than eighty percent. It should be particularly noted that the inter-rib spacing decreases from the lower end 14 to the upper end 12 and the cross-sectional area of the protruding ribs decreases in a similar fashion to provide fine and coarse shaving zones as is hereinafter described.

Turning back to FIG. 1B, a first inlet 66 introduces a liquid, such as water, into the casing 10 at a predetermined volumetric flow rate. The first inlet 66 is mounted upon the separation barrel 16 proximate the casing upper end 12 so as to permit the barrel to rotate thereunder and is disposed so as to direct the liquid from the casing upper end 12 to the casing lower end 14 against the upward urging of the helical riffle 62. The fact that each rib-section of the helical riffle protrudes inwardly from the inner surface of the casing 10 by an amount in the range of $\frac{1}{8}$ to $\frac{3}{4}$ inch (0.32 to 1.9 cm), coupled with the casing being tilted relative to the horizontal, causes turbulence in the liquid flow closely resembling that caused by a riffle in a stream and causes a partial dam at each rib-section (FIG. 5) having a configuration determined by the tilt angle $\theta$ (FIG. 1A) and the inward protrusion, the importance of which is hereinafter described.

As the fines are urged upwardly towards the heavy fines outlet 61 by the rotation of the helical riffle 62 they are compacted into density layers by the tilted-rotational action with the heavier fines occupying the lowermost layers proximate the inner surface of the casing 10. Turbulence in the liquid flow shaves off the light fines and combines them with the liquid to be urged thereby toward an outlet 64. Additionally, the predetermined cross-sectional area and configuration of each rib-portion of the helical riffle 62 prevents heavy fines from being washed away by the downward force of the liquid flow, and the partial dam thereat allows small particles of the valuable metal shaved off at an upstream rib-portion to settle therein and compact with the heavy fines and, hence, provides second-chance particle density testing at each rib-portion. The combustion of riffling-like turbulence and settling dams provides a gravitational shaving effect wherein the fines are repeatedly tested according to their respective densities with only those particles lacking a predetermined density, and thus not containing the metal, being shaved off and flushed out of the classifier by the downward force of the liquid. Moreover, the intensity of the shaving force is emphasized and de-emphasized in the fine and coarse zones, respectively, due to the progressive diminishment of rib cross-sectional area and transverse spacing. Accordingly, only a minimum amount of the fine particles actually containing the valuable metal is lost, while the greater amount thereof combines with the heavy fines to form a concentrate. It is important to note that, although the rib shape set forth in FIG. 5 produces optimum riffling and an optimum dam at each rib-section of the helical riffle 62, gravitational shaving action can also be obtained by using alternate rib shapes such as those indicated in cross section in FIGS. 6 and 7. It is especially important to note that the height, width, configuration and transverse spacing of the plurality of rib members comprising the helical riffle must be carefully selected for each zone of the classifier according to the particular type of metal ore being processed. For gold operations, test results indicate that a progressive diminishment from generally square $\frac{3}{8}$ (0.9 cm) ribs transversely spaced at 18 inch (45.7 cm) intervals (FIG. 5) to $\frac{1}{4}''$ (0.6 cm) ribs transversely spaced at 10 inch (25.4 cm) intervals from the lower end 14 to the upper end 12 produces optimum gravitational shaving. When the rib-sections of the helical riffle 62 are mounted on the casing 10 by welding, the weld 63 is placed on the downstream side in order to avoid bridging of the dam created thereat.

As shown in FIG. 2, the casing upper end 12 includes a downturned flange 68 and a flexible wiper 70 riding on the flange to dislodge heavy fines therefrom and urge them to a collection tray 72 communicating with a concentrate discharge chute 74. It is important to note that some metals, e.g. gold, have a tendency to adhere to other metals. Accordingly, in the absence of apparatus to overcome this adherence, some of the heavy fines will travel away from the collection tray 72 upon the surface of the casing 10 rather than falling into the collection tray and, hence, this feature further enhances the recovery percentage.

The casing lower end 14 includes an upturned flange 76 which impedes the flow of the liquid from the casing and, hence, provides a partial dam interior of the light fines outlet 64. A portion of the fines fall so proximate the light fines outlet 64 as to preclude the prerequisite compaction and, hence, unless some recapture mechanism is provided interior of the light fines outlet, the recovery rate will be unduly diminished. The fact that a partial dam is provided by the present invention interior of the light fines outlet 64 permits fines having the prerequisite density to settle therein, compact and be captured by the helical riffle 62 for circulation through the system while fines lacking the prerequisite density will be flushed out of the classifying assembly by the force of the liquid flowing therethrough.

Figures 1B, 5, 8:
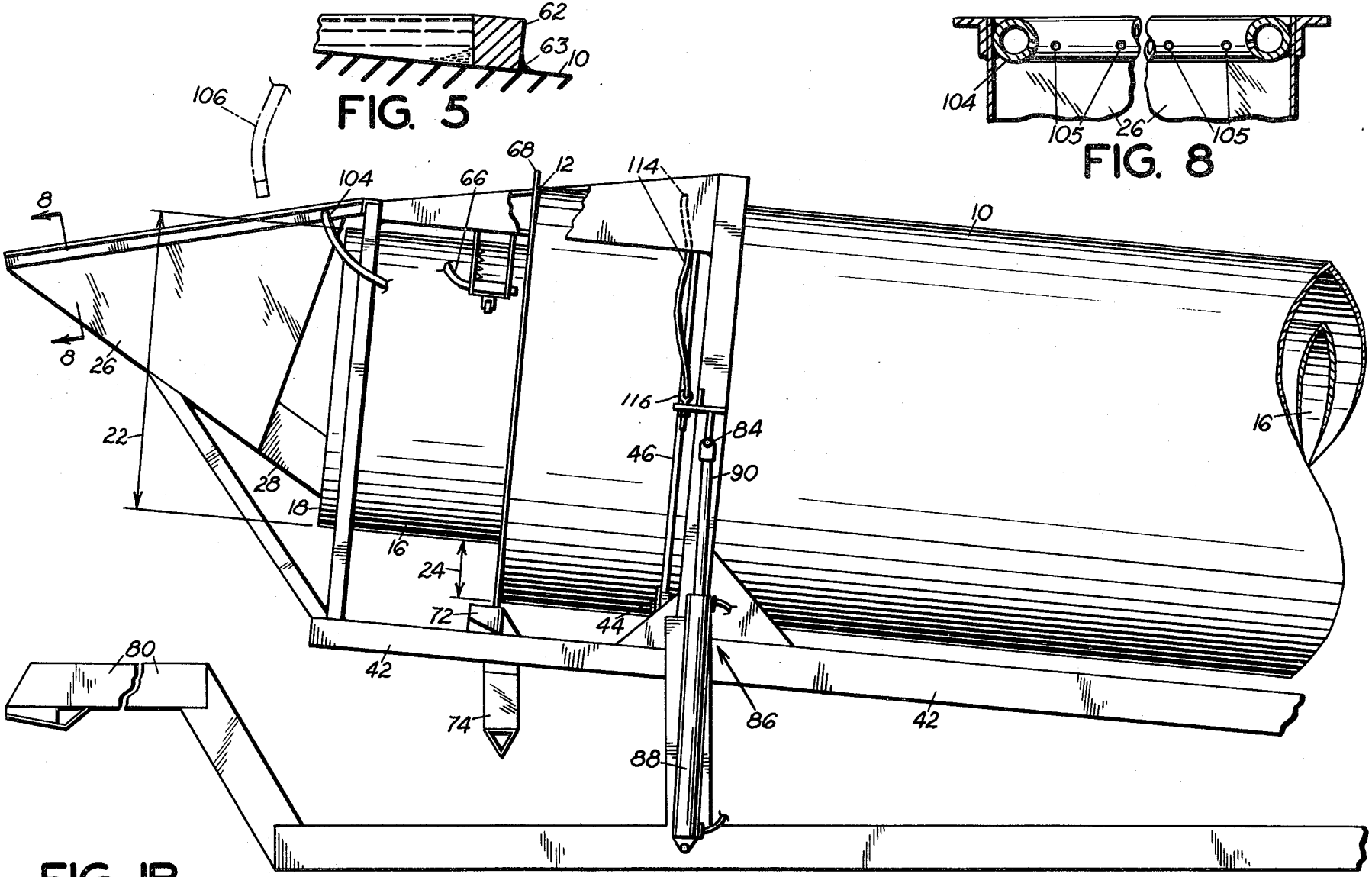

Referring again to FIGS. 1A and 1B, the casing support member 42 is pivotably mounted, at its lower end 78, upon a suitable support structure. In the portable version of the preferred embodiment, the support structure is a vehicular trailer 80, while the fixed-site embodiment uses a pallet 82 (FIG. 4) as a support structure. As seen in FIG. 1B, the casing support member 42 is supported at its upper end by a hydraulic ram 86 pivotably connected to the support structure 80. The ram cylinder 88 draws its fluid from the hydraulic pump 54 via a conventional selectively-activated valve (not shown) and thereby varies the casing tilt angle $\theta$ by selectively raising or lowering a piston (not shown) and a piston rod 90. The adjustable tilt mechanism permits the casing 10 to be transported in a horizontal position as shown in FIG. 4 and to be operated in a tilted position as shown in FIGS. 1A and 1B. This feature permits the construction of a relatively large capacity classifier which is portable and can be transported in a lowered position to comply with vehicular height regulations and quickly raised to an elevated work position at remote locations. More importantly, this feature permits the operator to observe the shaving action occurring in the open working area 24 and selectively adjust the tilt angle $\theta$ (FIG. 1A) to effect a coarse adjustment of the shaving action. In use, initial classifying action begins with a tilt angle $\theta$ roughly approximate the angle $\theta$ shown in FIG. 1A and, thereafter, the tilt angle $\theta$ is increased or decreased to maintain the richness of the concentrate. It should be particularly noted that a large tilt angle $\theta$ reduces the partial dam at the light fines outlet 64 and at each rib-section of the helical riffle 62 and increases the intensity of the shaving force throughout the coarse and fine shaving zones, thereby increasing through-put efficiency by lowering the percentage of fines recirculated through the system. A fine adjustment of the gravitational shaving force intensity is also periodically effected by turning the conventional control valve (not shown) so as to vary the volumetric flow rate of the liquid. The simplicity and effectiveness of the coarse and fine intensity adjustments permits the operator to monitor the shaving action occurring in the open working area and to maintain the heavy fines within a predetermined range of densities.

Referring particularly to FIG. 4, the perforate member 38 of the separator barrel comprises a pair of elongate meshing screens 92 and 94. A first elongate meshing screen 92 intermediate the crushing station 32 and the light fines outlet 64 has a $\frac{1}{8}$ inch (0.32 cm) mesh to permit only fines having a cross-sectional area not greater than $\frac{1}{8}$ inch to fall into the working space 24. A second elongate meshing screen 94 extends from the lower end of the first screen 92 to a conveyor 96 suitably mounted external of the classifier and has a $\frac{3}{4}$ inch (2.4 cm) mesh to permit particles having a cross-sectional area greater than $\frac{1}{8}$ inch but not greater than $\frac{3}{4}$ inch to fall into either the nugget trap 98 or the spacing intermediate the nugget trap and the conveyor 96.

The second screen 94 permits collection of relatively large particles for further processing and thereby provides nugget recoverability externally of the classifying chamber in order to provide free access to the nuggets without requiring the operator to physically enter the classifier. An inlet 100 formed in the lower portion of the nugget trap 98 can be closed or open during operations, as desired. When the inlet 100 is open, nuggets are automatically discharged therefrom thereby providing nugget recoverability without necessitating a system shut down. The nugget trap can also include a fluid inlet and a dam area (not shown but similar to that used within the classifier) to provide gravitational classification of the nuggets. Alternatively, the nuggets can be further processed through a second classifier similar to the classifier described herein but having an enhanced gravitational shaving action in order to collect nuggets having a predetermined range of densities.

A conventional liquid distribution system is provided which provides conduits and individual conventional control valves (not shown) for distributing a liquid at predetermined volumetric flow rates to the first inlet 66 and to second, third and fourth inlets 102–106, respectively. As described earlier, the first inlet 66 (FIG. 1B) directs a liquid at a predetermined flow rate through the casing 10 to provide the prerequisite gravity shaving force.

Referring to FIG. 1A, the second inlet 102 comprises a flexible conduit mounted adjacent the barrel lower end 20 and has sufficient length to permit the operator to direct a liquid at a predetermined volumetric flow rate upon the first and second screens 92 and 94, respectively, in order to prevent particles from adhering thereto and thereby blocking the perforations thereof. This feature further enhances through-put efficiency by precluding bridging of the perforations and by eliminating the necessity for interrupting system operations to unclog the classifier. This feature additionally enhances recovery efficiency by preventing metal particles from adhering to the screen and thereby blocking the perforations thereof. The control valve (not shown) permits the operator to variably select a predetermined volumetric flow rate which is sufficient to negate bridging and metal adherence without preventing particle advancement.

Turning now to FIG. 8, the third inlet 104 comprises a rigid conduit disposed about the upper periphery of the aggregate hopper 26 and having transversely spaced perforations 105 therein plus a control valve (not shown) so as to inject a liquid at a predetermined volumetric flow rate at a plurality of positions around the periphery of the aggregate hopper. These liquid flows prevent heavy fines from adhering to the vertical walls of the hopper 26 and encourage the aggregate placed therein to move into the separation barrel 16 via the inlet chute 28.

Referring back to FIG. 1B, the fourth inlet 106 is a flexible conduit having a control valve (not shown) and an excess length so as to permit its use at any location within the system. In use, this feature is generally utilized to provide a supplemental liquid flow to the aggregate hopper 26, however, it is also useful in supplying supplemental liquid flow at any other site within the system and for cleanup operations.

Returning now to FIG. 1A, the portable embodiment provides a pump 108 coupled to the drive engine 52 for pumping a liquid from an external reservoir to the liquid distribution system. The pump 108 coupled with a suitable gasoline engine 52, a hydraulic pump 54, and a hydraulic motor 56, or their equivalents, provides the classifier with an integral power system capable of supplying the total energy requirements of the classifier and thereby permits the operation thereof at a remote location having minimum facilities and allows testing of remote placer mines to determine whether the prerequisite metal percentage is present in the aggregate ore thereof without necessitating the presence of electrical power outlets or the like.

Turning to FIG. 4, since the crushing station 32 is subjected to considerable detrimental forces from the combination of the abrasive aggregate and the beating action of the chains 34, it is comprised of three 120° arcial sections 110 (best seen in FIG. 2) in order to facilitate removal and replacement thereof. It is important to note in this regard that the separation barrel 16 is mounted within the casing 10 using dual opposite-threaded she bolts 112 in order to further facilitate installation thereof. This construction coupled with the simplicity of design and operation permits the system to be readily manufactured at relatively modest costs and enhances system efficiency by minimizing repairs and maintenance efforts.

Referring now to FIG. 1B, an excess length tiedown cable 114 and adjustable eyebolts 116 retain the casing 10 upon the support structure. This feature, coupled with the mounting scheme depicted in FIGS. 1A and 1B is designed to permit operation of the system upon a vehicular trailer and, hence, provides rapid set-up time. Although the gravitational shaver of the present invention is applicable to large mining operations as indicated by the fixed-site embodiment of FIG. 4, the primary objective of the present invention is to encourage the recovery of valuable metals at diverse locations which were heretofore abandoned for want of an efficient and economical recovery apparatus by providing a self-contained, portable classifier, requiring a minimum installation time, and providing reliable classification of aggregate ore into a concentrate comprised of particles having a density within a predetermined range independently of changes in the particular characteristics of a wide range of aggregate ore. In this regard it is important to note that certain provisions are not shown in FIG. 4 for the fixed-site embodiment for purposes of clarity and similar omissions are made with regard to the portable embodiment in (FIGS. 1A and 1B) also for purposes of clarity and not to limit these features to a particular embodiment.

The terms and expressions which have been employed in the foregoing abstract and specifications are used therein as terms of description and not of limitation, and there is no intention in the use of such terms and expressions, of excluding equivalents of the features shown and described, or portions thereof, it being recognized that the scope of the invention is defined and limited only by the claims which follow.

What is claimed is:

1. An apparatus for separating a metal-bearing aggregate ore being supplied thereto into first particles having a predetermined range of cross sections and second particles having cross sections greater than those of said first particles and for thereafter classifying said first particles into concentrates having a predetermined range of densities and tailings having densities less than those of said concentrates so as to maintain said concentrates within said predetermined density range substantially independently of changes in the particular characteristics of aggregate ore being processed therein, said apparatus comprising:

(a) an elongate inner chamber having upper and lower ends, an inlet proximate said upper end thereof for permitting the introduction of said aggregate ore thereto and selection means for selecting said first particles from said aggregate ore including passage means for permitting said first particles to pass from said inner chamber;

(b) an elongate outer chamber housing said inner chamber and having upper and lower ends and an inner configuration sufficiently greater than the outer configuration of said inner chamber so as to define a working space therebetween, said outer chamber being disposed relative to said inner chamber such that said first particles passing from said inner chamber enter into said working space;

(c) movement means mounted on the inner surface of said outer chamber for urging said first particles passing into said working space in a first direction toward said upper end of said outer chamber;

(d) compaction means for compacting said first particles upon said movement means into density layers with said concentrates moving to the lowermost layers;

(e) shaving means for directing a liquid flow through said outer chamber directly over the surfaces of said movement means in a second direction opposite to said first direction toward said lower end of said outer chamber, said shaving means applying sufficient hydraulic separative force to said first particles upon said movement means so as to agitate same sufficiently to remove said tailings therefrom and to move said tailings in said second direction; and (f) said shaving means including a helical riffle, said riffle being comprised of a plurality of elongate ribs radially spaced about the inner surface of said outer chamber and helically spaced from each other by a predetermined distance, said helical spacing decreasing from a lower end of said outer chamber toward an upper end thereof, said elongate ribs protruding from the inner surface of said outer chamber and extending helically from said lower end to said upper end thereof, and wherein the protrusion of said ribs decreases from a first height proximate said lower end to a second height proximate said upper end so as to urge said first particles thereon in said first direction when said inner and outer chambers are rotated, create turbulence in said liquid flow and present a plurality of partial dams therefor.

2. The apparatus of claim 1 further comprising support means for rotatably supporting said inner and outer chambers above a working surface and means for rotating said inner and outer chambers, wherein said support means maintains said inner and outer chambers in a tilted orientation such that said inner and outer chambers form a tilt angle relative to said working surface, wherein said selection means includes a crushing compartment communicating with said inlet and said inner chamber and crushing means mounted within said crushing compartment for crushing at least some conglomerates in said aggregate ore and for releasing said first particles trapped within said conglomerates, wherein the tilted-rotational action of said inner chamber urges said aggregate ore from said crushing compartment to said inner chamber and separates said aggregate ore into said first and second particles, and wherein said passage means includes a perforate sidewall formed in said inner chamber interior of said crushing compartment having sufficient openings formed therein so as to permit said first particles to pass into said outer chamber.

3. The apparatus of claim 1 wherein said shaving means includes directing means for directing said liquid flow through said outer chamber, fine shaving control means for selectively varying the volumetric flow rate of said liquid flow, and coarse shaving control means for selectively varying said tilt angle, said fine and coarse shaving control means being selectively actuated during operation of said apparatus to selectively vary the intensity of the separative shaving force caused by the combination of said liquid flow and said helical riffle so as to maintain said concentrates within said predetermined density range.

4. The apparatus of claim 3 further comprising a raised outlet means disposed at said lower end of said outer chamber for impeding said liquid and said first particles flowing therefrom, and removal means disposed at said upper end of said outer chamber for removing said concentrates therefrom.

* * * * *